US006446580B2

(12) United States Patent
Franke et al.

(10) Patent No.: US 6,446,580 B2
(45) Date of Patent: Sep. 10, 2002

(54) FOSSIL FUEL-FIRED CONTINUOUS-FLOW STEAM GENERATOR

(75) Inventors: Joachim Franke, Altdorf; Rudolf Kral; Eberhard Wittchow, both of Erlangen, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/883,446

(22) Filed: Jun. 18, 2001

Related U.S. Application Data

(63) Continuation of application No. PCT/DE99/03896, filed on Dec. 6, 1999.

(30) Foreign Application Priority Data

Dec. 18, 1998 (DE) ..... 198 58 780

(51) Int. Cl.[7] ..... F22G 3/00

(52) U.S. Cl. ..... 122/6 A; 122/1 B; 122/406.3; 122/460

(58) Field of Search ..... 122/1 B, 1 C, 122/6 A, 406.3, 406.4, 451 S, 459, 460

(56) References Cited

U.S. PATENT DOCUMENTS

| | | | | |
|---|---|---|---|---|
| 3,136,298 A | | 6/1964 | Fredenberg et al. | |
| 3,527,261 A | | 9/1970 | Bigler et al. | |
| 3,927,646 A | * | 12/1975 | Dungey et al. | 122/6 A |
| 4,075,979 A | * | 2/1978 | Michel | 122/406.4 |
| 4,290,389 A | * | 9/1981 | Palchik | 122/406.4 |
| 4,987,862 A | * | 1/1991 | Wittchow et al. | 122/6 A |

FOREIGN PATENT DOCUMENTS

| | | |
|---|---|---|
| DE | 4427859 A1 | 10/1995 |
| DE | 4431185 A1 | 3/1996 |
| DE | 19645748 C1 | 3/1998 |
| DE | 19651678 A1 | 6/1998 |
| EP | 0 450 072 A1 | 10/1991 |
| WO | WO 92/18807 | 10/1992 |
| WO | WO 99/64787 | 12/1999 |

OTHER PUBLICATIONS

J. Franke et al: "Verdampferkonzepte für Benson®–Dampferzeuger" Evaporator Concepts for Benson® Steam Generators, VGB Kraftwerkstechnik 73, 1993, vol. 4, pp. 352–361.

* cited by examiner

*Primary Examiner*—Gregory Wilson
(74) *Attorney, Agent, or Firm*—Laurence A. Greenberg; Werner H. Stemer; Ralph E. Locher

(57) ABSTRACT

The fossil fuel fired continuous-flow steam generator has a gas turbine combustion chamber for fossil combustibles. On the heating gas side a vertical gas extractor is mounted downstream of a horizontal gas extractor. The walls surrounding the combustion chamber are composed of vertical evaporator tubes that are welded together. During operation the temperature differences between adjacent evaporator tubes of the combustion chamber are kept as low as possible. The burners are arranged at the level of the horizontal gas extractor. For a number of evaporator tubes which can be simultaneously impinged by the flow medium the ratio of the steam generating capacity M (in kg/s) at full load and of the sum A (in $m^2$) of the inner cross-sectional surfaces of the same evaporator tubes is less than 1350 (in $kg/sm^2$).

17 Claims, 3 Drawing Sheets

FOSSIL FUEL-FIRED CONTINUOUS-FLOW STEAM GENERATOR

CROSS-REFERENCE TO RELATED APPLICATION

This application is a continuation of copending International Application No. PCT/DE99/03896, filed Dec. 6, 1999, which designated the United States.

BACKGROUND OF THE INVENTION

FIELD OF THE INVENTION

The invention lies in the fields of thermodynamics and power generation. The invention relates, more specifically, to a continuous-flow steam generator having a combustion chamber for fossil fuel, which is followed on the fuel-gas side, via a horizontal flue, by a vertical gas flue, the containment walls of the combustion chamber being formed from vertically arranged evaporator tubes welded to one another in a gastight manner.

In a power plant with a steam generator, the energy content of a fuel is utilized for the evaporation of a flow medium in the steam generator. The flow medium is thereby conventionally carried in an evaporator circuit. The steam supplied by the steam generator may, in turn, be provided, for example, for driving a steam turbine and/or for a connected external process. When the steam drives a steam turbine, a generator or a working machine is normally operated via the turbine shaft of the steam turbine. Where a generator is concerned, the current generated by the generator may be provided for feeding into an interconnected network and/or an isolated network.

The steam generator may thereby be designed as a continuous-flow steam generator, also referred to as a once-through generator. A continuous-flow steam generator is known from the paper "Verdampferkonzepte fur Benson-Dampferzeuger" ["Evaporator concepts for Benson steam generators"] by Franke, Köhler, and Wittchow, published in VGB Kraftwerkstechnik 73 (1993), No. 4, pages 352–60. In a continuous-flow steam generator, the heating of steam generator tubes provided as evaporator tubes leads to an evaporation of the flow medium in the steam generator tubes in a single pass.

Continuous-flow steam generators are conventionally designed with a combustion chamber in a vertical form of construction. This means that the combustion chamber is designed for the heating medium or fuel gas to flow through in an approximately vertical direction. The combustion chamber may thereby be followed on the fuel-gas side by a horizontal gas flue, a deflection of the fuel-gas stream into an approximately horizontal flow direction taking place at the transition from the combustion chamber into the horizontal gas flue. However, in general, on account of the thermally induced changes in length of the combustion chamber, combustion chambers of this type require a scaffold on which the combustion chamber is suspended. This necessitates a considerable technical outlay in terms of the manufacture and assembly of the continuous-flow steam generator. The outlay is all the greater, the greater the overall height of the continuous-flow steam generator. This occurs particularly in the case of continuous-flow steam generators which are configured for a steam power output of more than 80 kg/s under full load.

A continuous-flow steam generator is not subject to any pressure limitation, so that it is possible to have live-steam pressures well above the critical pressure of water ($p_{cri}$=221 bar) where there is still only a slight density difference between liquid-phase and steam-phase medium. A high live-steam pressure is conducive to high thermal efficiency and therefore to low $CO_2$ emissions of a fossil-fired power station which may be fired, for example, with (hard) coal or else with lignite (brown coal) as fuel.

A particular problem is presented by the design of the containment wall of the gas flue or combustion chamber of the continuous-flow steam generator with regard to the tube-wall or material temperatures which occur there. In the subcritical pressure range up to about 200 bar, the temperature of the containment wall of the combustion chamber is determined essentially by the height of the saturation temperature of water when wetting of the inner surface of the evaporator tubes can be ensured. This is achieved, for example, by the use of evaporator tubes which have a surface structure on their inside. For this purpose, in particular, internally ribbed evaporator tubes may be considered, for which the use in a continuous-flow steam generator is known, for example, from the abovementioned paper. These so-called ribbed tubes, that is to say tubes with a ribbed inner surface, have particularly good heat transfer from the tube inner wall to the flow medium.

Experience has shown that it is not possible to avoid the situation where the containment wall of the combustion chamber is heated to a differing extent. Due to the different heating of the evaporator tubes, the outlet temperatures of the flow medium from evaporator tubes heated to a greater extent may therefore, in the case of continuous-flow steam generators, be generally higher than where evaporator tubes heated to a normal or lesser extent are concerned. Temperature differences between adjacent evaporator tubes may thereby arise, leading to thermal stresses which may reduce the useful life of the continuos-flow steam generator or may even cause tube cracks.

SUMMARY OF THE INVENTION

The object of the present invention is to provide a fossil-fired continuous-flow steam generator of the above-mentioned type which overcomes the above-noted deficiencies and disadvantages of the prior art devices and methods of this general kind, and which requires a particularly low outlay in terms of manufacture and assembly and, moreover, during the operation of which temperature differences between adjacent evaporator tubes of the combustion chamber are kept particularly low. It is a further object to provide a continuous-flow steam generator which is especially easy to produce and assemble.

With the above and other objects in view there is provided, in accordance with the invention, a continuous-flow steam generator, comprising:

- a combustion chamber having a plurality of burners for fossil fuel and having a fuel-gas side;
- a horizontal gas flue substantially at a level with said burners and a vertical gas flue following said combustion chamber on said fuel-gas side;
- said combustion chamber having containment walls formed from substantially vertically arranged evaporator tubes welded to one another in a gastight manner, and including a plurality of evaporator tubes each formed with inner ribs defining a multiple thread;
- a common inlet header system for a flow medium connected in common to a number of said evaporator tubes of said combustion chamber and a common outlet header system connected in common to said evaporator tubes, such that the number of said evaporator tubes can be acted upon in parallel by the flow medium;

wherein a quotient formed from a steam power output (given in kg/s) under full load of the continuous-flow steam generator and a sum (given in $m^2$) of an inner cross-sectional area of said number of said evaporator tubes capable of being acted upon in parallel by the flow medium is smaller than 1350 (given in $kg/sm^2$).

In other words, the object of the invention are achieved with the continuous-flow steam generator that has a combustion chamber with a number of burners arranged level with the horizontal gas flue and designed in such a way that, in each case for a number of evaporator tubes capable of being acted upon in parallel by flow medium, the quotient formed from the steam power output M (given in kg/s) under full load and the sum of the inner cross-sectional areas A (given in $m^2$) of these evaporator tubes capable of being acted upon in parallel by flow medium is smaller than 1350 (given in $kg/sm^2$.)

The invention proceeds from the notion that a continuous-flow steam generator capable of being produced at a particularly low outlay in terms of manufacture and assembly should have a suspension structure capable of being executed by simple means. A scaffold to be produced at a comparatively low technically outlay for the suspension of the combustion chamber may at the same time be accompanied by a particularly low overall height of the continuous-flow steam generator. A particularly low overall height of the continuous-flow steam generator can be achieved by designing the combustion chamber in a horizontal form of construction. For this purpose, the burners are arranged level with the horizontal gas flue in the combustion chamber wall. Thus, when the continuous-flow steam generator is in operation, the fuel gas flows through the combustion chamber in approximately horizontal main flow direction.

In the case of a horizontal combustion chamber, however, when the continuous-flow steam generator is in operation the rear region of the combustion chamber, as seen on the fuel-gas side, is heated to a comparatively lesser extent than the front region of the combustion chamber, as seen on the fuel-gas side. Moreover, for example, an evaporator tube in proximity to a burner is heated to a greater extent than an evaporator tube arranged in a corner of the combustion chamber. Under these circumstances, in an extreme case, the heating may be about three times greater in the front region of the combustion chamber than in the rear region. In the context of the hitherto customary mass flow densities in the evaporator tubes, given in $kg/m^2s$ and in respect of 100% steam power output (full load), of 2000 $kg/m^2s$, the mass throughput decreases in a tube heated to a greater extent and increases in a tube heated to a lesser extent, in each case with respect to the average value of the mass throughput of all the tubes. This behavior is caused by the relatively high proportion of the frictional pressure loss in the total pressure drop of the evaporator tubes. Furthermore, because of the particularly low height of the combustion chamber, the relative differences in length of the evaporator tubes are appreciably greater than where a vertical combustion chamber is concerned. This additionally increases the differences in the heating and in the frictional pressure loss of the individual evaporator tubes. In order nevertheless to ensure approximately identical temperatures between adjacent evaporator tubes, the continuous-flow steam generator should be designed in such a way that a higher throughput of the flow medium is established automatically in an evaporator tube heated to a comparatively greater extent than in an evaporator tube heated to a comparatively lesser extent. This is generally the case when the geodetic pressure drop $\Delta p_G$ (given in bar) of an evaporator tube with average heating amounts to a multiple of its frictional pressure loss $\Delta p_R$ (given in bar) . The condition for an increase in throughput in an evaporator tube heated to a comparatively greater extent in the case of a constant mass flow is:

$$\left(\frac{\Delta(\Delta p_G + \Delta p_R + \Delta p_B)}{\Delta Q}\right)_{M=constant} = K < 0$$

where $\Delta p_B$ (given in bar) is a change in the acceleration pressure drop, $\Delta Q$ (given in kJ/s) is a change in the heating, M (given in kg/s) is the mass flow and K (given in (bar s)/kJ) is a constant. The condition formulated in this inequality states that, in the case of a constant mass flow, the total pressure loss $\Delta(\Delta p_G+\Delta \rho_R=\Delta p_B)$ (given in bar) must decrease under greater heating $\Delta Q$, that is to say must be mathematically negative. Hence, when the same total pressure loss prevails in a number of evaporator tubes, then the throughput of the flow medium must increase, according to the above-mentioned inequality, in an evaporator tube heated to a greater extent, as compared with an evaporator tube heated to a lesser extent.

Comprehensive calculations, then, have surprisingly yielded the fact that the condition formulated in the inequation is satisfied for continuous-flow steam generators with a horizontal combustion chamber when, for a number of evaporator tubes connected in parallel, the quotient of the steam power output M (given in kg/s) of the continuous-flow steam generator under full load and of the sum of the inner cross-sectional areas A (given in $m^2$) of these evaporator tubes connected in parallel is no higher than 1350 (given in $kg/sm^2$). Hence, formulated mathematically:

$$M/A<1350.$$

In this case, the steam power output M under the full load of the continuous-flow steam generator is also designated as the permissible steam generation or as the boiler maximum continuous rating (BMCR), and the respective inner cross-sectional area of an evaporator tube is with respect to a horizontal section.

Advantageously, in each case a number of evaporator tubes of the combustion chamber which are connected in parallel are preceded by a common inlet header system and followed by a common outlet header system for flow medium. To be precise, a continuous-flow steam generator produced in this design allows reliable pressure compensation between a number of evaporator tubes connected in parallel, so that in each case all the evaporator tubes connected in parallel have the same total pressure loss. This means that the throughput must increase according to the abovementioned inequation in the case of an evaporator tube heated to a greater extent, as compared with an evaporator tube heated to a lesser extent.

The evaporator tubes of the end wall of the combustion chamber advantageously precede on the flow-medium side the evaporator tubes of the containment walls which form the side walls of the combustion chamber. Particularly beneficial cooling of the highly heated end wall of the combustion chamber is thereby ensured.

In a further advantageous refinement of the invention, the tube inside diameter of a number of the evaporator tubes of the combustion chamber is selected as a function of the respective position of the evaporator tubes in the combustion chamber. The evaporator tubes in the combustion chamber can thereby be adapted to a heating profile predeterminable on the fuel-gas side. The influence thus exerted on the flow through the evaporator tubes keeps temperature differences at the outlet of the evaporator tubes of the combustion chamber low in a particularly reliable way.

For particularly good transmission of the heat of the combustion chamber to the flow medium carried in the evaporator tubes, a number of evaporator tubes advantageously have on their inside in each case ribs forming a multiple thread. In this case, advantageously, a pitch angle $\alpha$ between a plane perpendicular to the tube axis and the flanks of the ribs arranged on the tube inside is smaller than 60°, preferably smaller than 55°.

To be precise, in a heated evaporator tube designed as an evaporator tube without internal ribbing, a so-called smooth tube, it is no longer possible, from a specific steam content onward, to maintain the wetting of the tube wall necessary for particularly good heat transmission. When wetting is absent, there may be a tube wall which is dry in places. The transition to a dry tube wall of this type leads to a so-called heat transmission crisis with an impaired heat transmission behavior, so that, in general, the tube-wall temperatures rise particularly sharply at this point. In an internally ribbed evaporator tube, however, as compared with a smooth tube, this heat transmission crisis occurs only at a steam mass content of >0.9, that is to say just before the end of evaporation. This is attributable to the swirl which the flow experiences due to the spiral ribs. Due to the different centrifugal force, the water fraction is separated from the steam fraction and is transported to the tube wall.

The wetting of the tube wall is thereby maintained up to high steam contents, so that there are high flow velocities even at the location of the heat transmission crisis. This results, despite the heat transmission crisis, in relatively good heat transmission and consequently low tube-wall temperatures.

A number of the evaporator tubes of the combustion chamber advantageously have means for reducing the throughflow of the flow medium. In this case, it proves particularly beneficial if the means are designed as throttle devices. Throttle devices may, for example, be fittings in the evaporator tubes, said fittings reducing the tube inside diameter at a point inside the respective evaporator tube. At the same time, it also proves advantageous to have means for reducing the throughflow in a line system which comprises a plurality of parallel lines and through which flow medium can be supplied to the evaporator tubes of the combustion chamber. In this case, the line system may also precede an inlet header system of evaporator tubes capable of being acted upon in parallel by flow medium. In this case, for example, throttle fittings may be provided in a line or a plurality of lines of the line system. Such means for reducing the throughflow of the flow medium through the evaporator tubes make it possible to adapt the throughput of flow medium through individual evaporator tubes to the respective heating of these in the combustion chamber. As a result, in addition, temperature differences of the flow medium at the outlet of the evaporator tubes are kept particularly low in a particularly reliable way.

The side walls of the horizontal gas flue and/or of the vertical gas flue are advantageously formed from vertically arranged steam generator tubes welded to one another in a gastight manner and in each case capable of being acted upon in parallel by flow medium.

Adjacent evaporator or steam generator tubes are advantageously welded to one another in a gastight manner on their longitudinal sides via metal bands, so-called fins. These fins may already be firmly connected to the tubes during the process of manufacturing the tubes and form a unit with these. This unit formed from a tube and fins is also designated as a finned tube. Information regarding the unit may be found in the commonly assigned U.S. Pat. No. 5,662,070, which is herewith incorporated by reference. The fin width influences the introduction of heat into the evaporator or steam generator tubes. The fin width is therefore adapted, preferably as a function of the position of the respective evaporator or steam generator tubes in the continuous-flow steam generator, to a heating profile predeterminable on the fuel-gas side. In this case, the predetermined heating profile may be a typical heating profile determined from experimental values or else a rough estimation, such as, for example, a stepped heating profile. As a result of the suitably selected fin widths, even when various evaporator or steam generator tubes are subjected to greatly differing heating, it is possible to achieve an introduction of heat into all the evaporator or steam generator tubes such that temperature differences at the outlet of the evaporator or steam generator tubes are kept particularly low. Premature material fatigues are reliably prevented in this way. The continuous-flow steam generator consequently has a particularly long useful life.

A number of superheater heating surfaces are advantageously arranged in the horizontal gas flue, which are arranged approximately perpendicularly to the main flow direction of the fuel gas and the tubes of which are connected in parallel for a throughflow of the flow medium. These superheater heating surfaces, arranged in a suspended form of construction and also designated as bulkhead heating surfaces, are heated predominantly by convection and follow the evaporator tubes of the combustion chamber on the flow-medium side. Particularly beneficial utilization of the fuel-gas heat is thereby ensured.

Advantageously, the vertical gas flue has a number of convection heating surfaces which are formed from tubes arranged approximately perpendicularly to the main flow direction of the fuel gas. These tubes of a convection heating surface are connected in parallel for a throughflow of the flow medium. These convection heating surfaces, too, are heated predominantly by convection.

In order, furthermore, to ensure particularly full utilization of the heat of the fuel gas, the vertical gas flue advantageously has an economizer.

Advantageously, the burners are arranged on the end wall of the combustion chamber, that is to say on that side wall of the combustion chamber which is located opposite the outflow orifice to the horizontal gas flue. A continuous-flow steam generator designed in this way can be adapted particularly simply to the burnup length of the fuel. By the burnup length of the fuel is to be meant, here, the fuel-gas velocity in the horizontal direction at a specific average fuel-gas temperature, multiplied by the burnup time $t_A$ of the flame of the fuel. In this case, the maximum burnup length for the respective continuous-flow steam generator is obtained at the steam power output M under the full load of the continuous-flow steam generator, the so-called full-load operating mode. The burnup time $t_A$ of the flame of the fuel is, in turn, the time which, for example, a coaldust grain of average size requires to burn up completely at a specific average fuel-gas temperature.

In order to keep material damage and undesirable contamination of the horizontal gas flue, for example due to the introduction of high-temperature molten ash, particularly low, the combustion chamber length defined by the distance from the end wall to the inlet region of the horizontal gas flue is advantageously at least equal to the burnup length of the fuel when the continuous-flow steam generator is in the full-load operating mode. This horizontal length of the combustion chamber will generally amount to at least 80% of the height of the combustion chamber, as measured from the funnel top edge to the combustion chamber ceiling.

For particularly beneficial utilization of the combustion heat of the fossil fuel, the length L (given in m) of the combustion chamber is advantageously selected as a function of the steam power output M (given in kg/s) of the continuous-flow steam generator under full load, of the burnup time $t_A$ (given in s) of the flame of the fossil fuel and of the outlet temperature $T_{BRK}$ (given in ° C.) of the fuel gas from the combustion chamber. In this case, with a given steam power output M of the continuous-flow steam generator under full load, approximately the higher value of the two functions (1) and (2) applies to the length L of the combustion chamber:

$$L(M, t_A)=(C_1+C_2\cdot W)\cdot t_A \text{ and}$$

$$L(M, T_{BRK})=(C_3\cdot T_{BRK}+C_4)W+C_5(T_{BRK})^2+C_6\cdot T_{BRK}+C_7$$

with $C_1$=8 m/s and $C_2$=0.0057 m/kg and $C_3=1.905\cdot 10^{-4}$ (m·s)/(kg° C.) and $C_4$=0.286(s·m)/kg and $C_5=3\cdot 10^{-4}$ m/(° C.)$^2$ and $C_6$=0.842 m/° C. and $C_7$=603.41 m.

The term "approximately" as used in this context allows a permissible deviation from the value defined by the respective function of +20%–10%.

The advantages achieved by means of the invention are, in particular, that the suitable choice of the ratio between the steam power output of the continuous-flow steam generator at the full load for a number of evaporator tubes connected in parallel and the inner cross-sectional areas of these evaporator tubes ensures that the throughput of the flow medium through the evaporator tubes is adapted particularly well to the heating and that the temperatures at the outlet of the evaporator tubes are therefore virtually identical. When the continuous-flow steam generator is in operation, the thermal stresses in the containment wall of the combustion chamber, which are caused by temperature differences between adjacent evaporator tubes, remain in this case well below the values at which there is, for example, the risk of tube cracks. It is subsequently possible to employ a horizontal combustion chamber in a continuous-flow steam generator, even with a comparatively long useful life. Moreover, designing the combustion chamber for an approximately horizontal main flow direction of the fuel gas affords a particularly compact form of construction of the continuous-flow steam generator. This makes it possible, when the continuous-flow steam generator is incorporated into a power station with a steam turbine, also to have particularly short connecting tubes from the continuous-flow steam generator to the steam turbine.

Other features which are considered as characteristic for the invention are set forth in the appended claims.

Although the invention is illustrated and described herein as embodied in a fossil-fired continuous-flow steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

Identical and functionally equivalent parts are identified with the same reference symbols throughout the figures.

DESCRIPTION OF THE PREFERRED EMBODIMENTS

Figure 1:
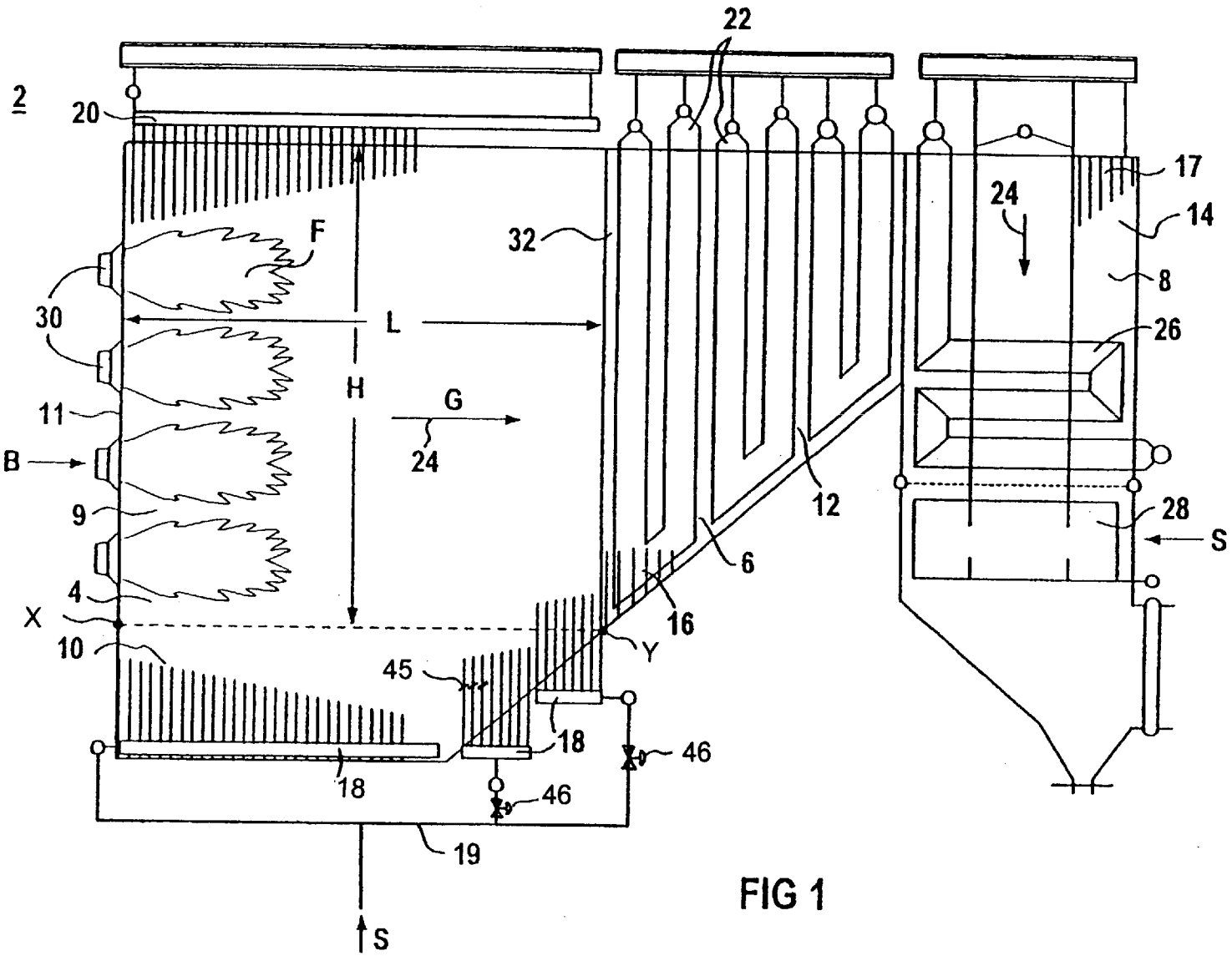
FIG. 1 is a diagrammatic side view of a fossil-fired continuous-flow steam generator of the two-flue type.

Referring now to the figures of the drawing in detail and first, particularly, to FIG. 1 thereof, there is seen a continuous-flow steam generator 2 which is assigned to a power plant that is not illustrated in any detail and which also comprises a steam turbine plant. In the exemplary case, the continuous-flow steam generator is designed for a steam power output under full load of at least 80 kg/s. The steam generated in the continuous-flow steam generator 2 is in this case utilized for driving the steam turbine which itself, in turn, drives a generator for current generation. The current generated by the generator is in this case provided for feeding into an interconnected power grid or an isolated network.

The fossil-fired continuous-flow steam generator 2 comprises a combustion chamber 4 which is designed in so-called horizontal form of construction and which is followed on the fuel-gas side, via a horizontal gas flue 6, by a vertical gas flue 8. Containment walls 9 of the combustion chamber 4 are formed from vertically arranged evaporator tubes 10 which are welded to one another in a gastight manner and a number N of which can be acted upon in parallel by flow medium S.

Here, one of the containment walls 9 of the combustion chamber 4 is the end wall 11. In addition, the side walls 12 of the horizontal gas flue 6 and 14 of the vertical gas flue 8 may also be formed from vertically arranged steam generator tubes 16 and 17 welded to one another in a gastight manner. In this case, the steam generator tubes 16 and 17 are in each case capable of being acted upon in parallel by flow medium S.

A number of the evaporator tubes 10 of the combustion chamber 4 are preceded on the flow-medium side by an inlet header system 18 for flow medium S and followed by an outlet header system 20. The inlet header system 18 comprises in this case a number of parallel inlet headers. At the same time, a line system 19 is provided for feeding flow medium S into the inlet header system 18 of the evaporator tubes 10. The line system 19 comprises a plurality of lines which are connected in parallel and are in each case connected to one of the inlet headers of the inlet header system 18.

Figure 2:
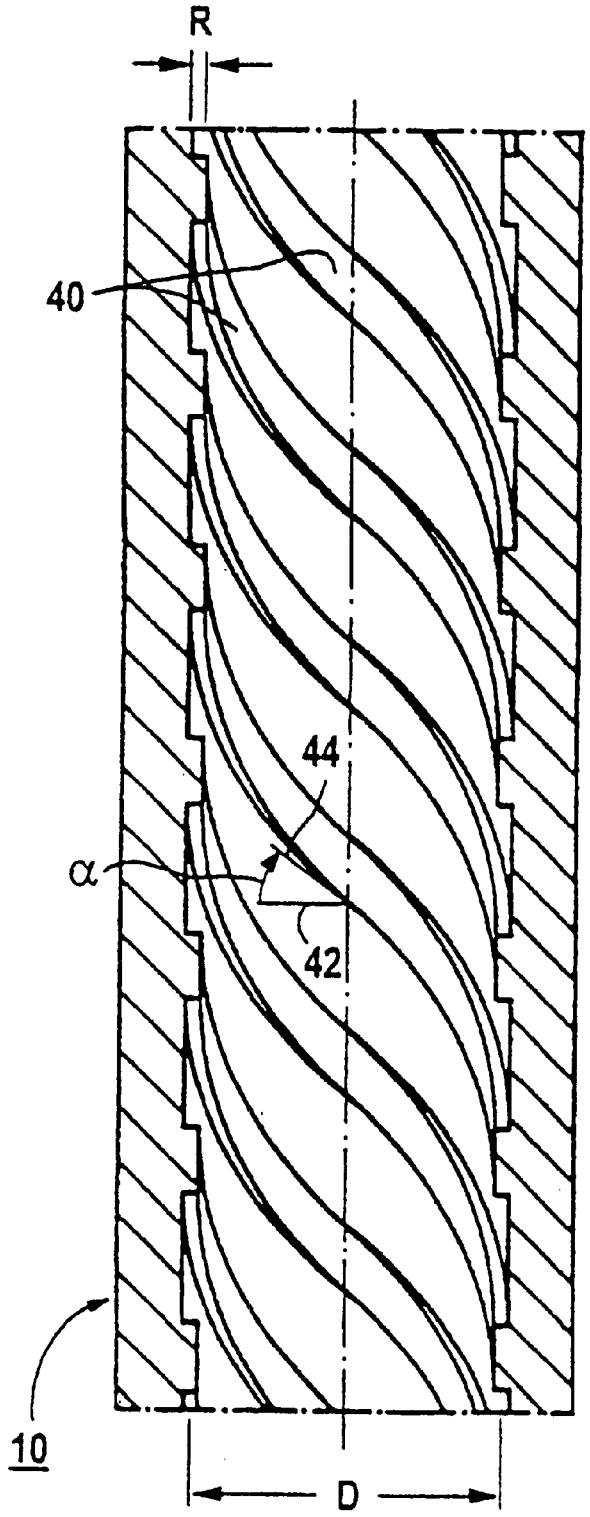
FIG. 2 is a diagram of a longitudinal section through an individual evaporator tube.

As illustrated in FIG. 2, the evaporator tubes 10 have a tube inside diameter D and, on their inside, ribs 40 which form a type of multiple thread with a rib height R. In this case, the pitch angle α between a plane 42 perpendicular to the tube axis and the flanks 44 of the ribs 40 arranged on the tube inside is smaller than 55°. A particularly high transfer of heat from the inner walls of the evaporator tubes 10 to the flow medium S carried in the evaporator tubes 10 and, at the same time, particularly low temperatures of the tube wall are achieved as a result.

The tube inside diameter D of the evaporator tubes 10 of the combustion chamber 4 is selected as a function of the respective position of the evaporator tubes 10 in the combustion chamber 4. The continuous-flow steam generator 2 is thereby adapted to the different heating of the evaporator tubes 10. This configuration of the evaporator tubes 10 of the combustion chamber 4 ensures particularly reliably that temperature differences at the outlet of the evaporator tubes 10 are kept particularly low.

As a means of reducing the throughflow of the flow medium S, some of the evaporator tubes 10 are equipped with throttle devices 45, which are diagrammatically indicated with oblique lines crossing the tubes 10. The throttle devices 45 are configured as perforated diaphragms which reduce the tube inside diameter D at one point and, when the continuous-flow steam generator 2 is in operation, bring about a reduction in the throughput of the flow medium S in the evaporator tubes 10 heated to a lesser extent, with the result that the throughput of the flow medium S is adapted to the heating. Furthermore, as a means for reducing the throughput of the flow medium S in the evaporator tubes 10, one or more lines of the line system 19 are equipped with throttle devices 46, in particular throttle fittings—diagrammtically indicated upstream of two of the inlet headers 18.

Adjacent evaporator or steam generator tubes 10, 16, 17 are welded to one another in a gastight manner on their longitudinal sides via fins in a way not illustrated in any more detail. To be precise, the heating of the evaporator or steam generator tubes 10, 16, 17 can be influenced by a suitable choice of the fin width. The respective fin width is therefore adapted to a heating profile which is predeterminable on the fuel-gas side and which depends on the position of the respective evaporator or steam generator tubes 10, 16, 17 in the continuous-flow steam generator 2. In this case, the heating profile may be a typical heating profile determined from experimental values or else a rough estimation. As a result, temperature differences at the outlet of the evaporator or steam generator tubes 10, 16, 17 are kept particularly low, even in the case of widely differing heating of the evaporator or steam generator tubes 10, 16, 17. Material fatigues are thereby reliably prevented, thus ensuring that the continuous-flow steam generator 2 has a long useful life.

When the horizontal combustion chamber 4 is being fitted with tubes, it must be borne in mind that the individual evaporator tubes 10 welded to one another in a gastight manner are heated in a widely differing way when the continuous-flow steam generator 2 is in operation. The design of the evaporator tubes 10 in terms of their internal ribbing, the fin connection to adjacent evaporator tubes 10 and their tube inside diameter D is therefore selected such that, despite being heated differently, all the evaporator tubes 10 have approximately identical outlet temperatures and sufficient cooling of all the evaporator tubes 10 is ensured for all the operating states of the continuous-flow steam generator 2. At the same time, the heating of some evaporator tubes 10 to a lesser extent when the continuous-flow steam generator 2 is in operation is additionally taken into account by the installation of throttle devices.

The tube inside diameters D of the evaporator tubes 10 in the combustion chamber 4 are selected as a function of their respective position in the combustion chamber 4. In this case, evaporator tubes 10 exposed to greater heating during the operation of the continuous-flow steam generator 2 have a larger tube inside diameter D than evaporator tubes 10 which are heated to a lesser extent during the operation of the continuous-flow steam generator 2. What is achieved thereby, as compared with the situation with identical tube inside diameters, is that the throughput of the flow medium S in the evaporator tubes 10 is increased with a larger tube inside diameter D and therefore temperature differences at the outlet of the evaporator tubes 10 as a result of different heating are reduced. A further measure for adapting the flow of flow medium S through the evaporator tubes 10 to the heating is the installation of throttle devices in some of the evaporator tubes 10 and/or in the line system 19 provided for the supply of flow medium S. By contrast, in order to adapt the heating to the throughput of the flow medium S through the evaporator tubes 10, the fin width may be selected as a function of the position of the evaporator tubes 10 in the combustion chamber 4. Despite the individual evaporator tubes 10 being heated to a widely differing extent, all the measures mentioned give rise to an approximately identical specific heat absorption of the flow medium S carried in the evaporator tubes 10, when the continuous-flow steam generator 2 is in operation, and therefore only slight temperature differences at their outlet. At the same time, the internal ribbing of the evaporator tubes 10 is designed in such a way that, in spite of different heating and a different throughflow of flow medium S, particularly reliable cooling of the evaporator tubes 10 is ensured in all the load states of the continuous-flow steam generator 2.

The horizontal gas flue 6 has a number of superheater heating surfaces 22 which are designed as bulkhead heating surfaces and are arranged in a suspended form of construction approximately perpendicularly to the main flow direction 24 of the fuel gas G and the tubes of which are in each case connected in parallel for a throughflow of the flow medium S. The superheater heating surfaces 22 are heated predominantly by convection and follow the evaporator tubes 10 of the combustion chamber 4 on the flow-medium side.

The vertical gas flue 8 has a number of convection heating surfaces 26 which are capable of being heated predominantly by convection and are formed from tubes arranged approximately perpendicularly to the main flow direction 24 of the fuel gas G. These tubes are in each case connected in parallel for a throughflow of the flow medium S. Moreover, an economizer 28 is arranged in the vertical gas flue 8. The vertical gas flue 8 issues on the outlet side into a further heat exchanger, for example into an air preheater, and from there, via a dust filter, into a chimney. The components following the vertical gas flue 8 are not illustrated in any more detail in FIG. 1.

The continuous-flow steam generator 2 is configured with a horizontal combustion chamber 4 of particularly low overall height and can therefore be set up at a particularly low outlay in terms of manufacture and assembly. For this purpose, the combustion chamber 4 of the continuous-flow steam generator 2 has a number of burners 30 for fossil fuel B, which are arranged at level with the horizontal flue 6 on the end wall 11 o f the combustion chamber 4.

So that the fossil fuel B burns up particularly completely to achieve particularly high efficiency and material damage to the first superheater heating surface 22 of the horizontal gas flue 6, as seen on the fuel-gas side, and also contamination of this surface, for example as a result of the introduction of high-temperature molten ash, are prevented in a particularly reliable way, the length L of the combustion chamber 4 is selected such that it exceeds the burnup length of the fuel B when the continuous-flow steam generator 2 is in the full-load operating mode. In this case, the length L is the distance from the end wall 11 of the combustion chamber 4 to the inlet region 32 of the horizontal gas flue 6. The burnup length of the fuel B is in this case defined as the fuel-gas velocity in the horizontal direction at a specific average fuel-gas temperature, multiplied by the burnup time $t_A$ of the flame F of the fuel B. The maximum burnup length for the respective continuous-flow steam generator 2 is obtained when the respective continuous-flow steam generator 2 is in the full-load operating mode. The burnup time $t_A$ of the flame F of the fuel B is, in turn, the time which, for example, a coaldust grain of average size requires to burn up fully at a specific average fuel-gas temperature.

In order to ensure a particularly beneficial utilization of the combustion heat of the fossil fuel B, the length L (given in m) of the combustion chamber 4 is suitably selected as a function of the outlet temperature $T_{BRK}$ (given in °C.) of the fuel gas G from the combustion chamber 4, of the burnup time $t_A$ (given in s) of the flame F of the fuel B and of the steam power output M (given in kg/s) of the continuous-flow steam generator 2 under full load. This horizontal length L of the combustion chamber 4 amounts in this case to at least 80% of the height H of the combustion chamber 4. The height H is in this case measured from the funnel top edge of the combustion chamber 4, marked in FIG. 1 by the line having the end points X and Y, to the combustion chamber ceiling. The length L of the combustion chamber 4 is determined approximately via the functions (1) and (2):

$$L(M, t_A)=(C_1+C_2\cdot M)\cdot t_A \quad (1)$$

And $$L(M, T_{BRK})=(C_3\cdot T_{BRK}+C_4)M+C_5(T_{BRK})^2+C_6\cdot T_{BRK}+C7 \quad (2)$$

With $C_1$=8 m/s and $C_2$=0.0057 m/kg and $C_3=1.905\cdot 10^{-4}$ (m·s)/(kg°C.) and $C_4$=0.286 (s·m)/kg and $C_5=3\cdot 10^{-4}$ m/(°C.)$^2$ and $C_6$=0.842 m/°C. and $C_7$=603.41 m.

The term "approximately" refers to a permissible deviation of +20%/−10% from the value defined by the respective function. In this case, the higher value from the functions (1) and (2) for the length L of the combustion chamber 4 is applicable in the design of the continuous-flow steam generator 2 for a predetermined steam power output M of the continuous-flow steam generator 2 under full load.

Figure 3:
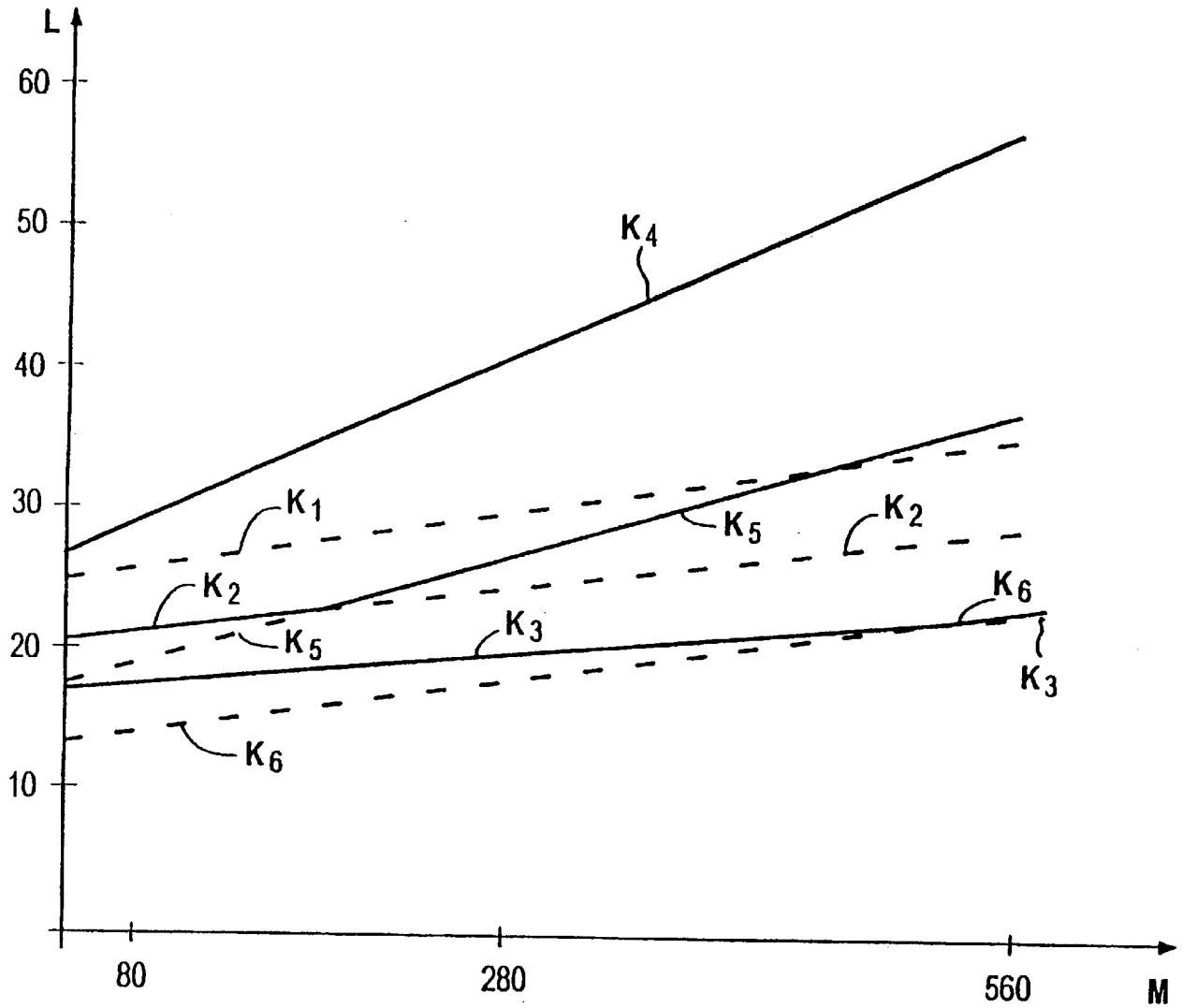
FIG. 3 is a graph plotting a system of coordinates with the curves $K_1$ to $K_6$.

As an example of a possible design of the continuous-flow steam generator 2, six curves $K_1$ to $K_6$ are plotted in the system of coordinates according to FIG. 3 for some lengths L of the combustion chamber 4 as a function of the steam power output M of the continuous-flow steam generator 2 under full load. Here, the curves are in each case assigned the following parameters:

$K_1$: $t_A$=3s according to (1), $K_2$: $t_A$=2.5s according to (1), $K_3$: $t_A$=2s according to (1), $K_4$: $T_{BRK}$=1200° C. according to (2), $K_5$: $T_{BRK}$=1300° C. according to (2), $K_6$: $T_{BRK}$=1400° C. according to (2).

Thus, for example for a burnup time $t_A$=3s and an outlet temperature $T_{BRK}$=1200° C. of the fuel gas G from the combustion chamber 4, the curves $K_1$ and $K_4$ are used in order to determine the length L of the combustion chamber 4. This yields, in the case of a predetermined steam power output M of the continuous-flow steam generator 2 under full load, with M=80 kg/s a length of L=29 m according to $K_4$, with M=160 kg/s a length of L=34 m according to $K_4$, with M=560 kg/s a length of L=57 m according to $K_4$.

The curve $K_4$ depicted as an unbroken line is therefore always applicable.

For example, the curves $K_2$ and $K_5$ are to be used for the burnup time $T_A$=2.5 s of the flame F of the fuel B and the outlet temperature of the fuel gas G from the combustion chamber $T_{BRK}$=1300° C. This yields, in the case of a predetermined steam power output M of the continuous-flow steam generator 2 under full load, with M=80 kg/s a length of L=21 m according to $K_2$, with M=180 kg/s a length of L=23 m according to $K_2$ and $K_5$, with M=560 kg/s a length of L=37 m according to $K_5$.

That part of the curve $K_2$ which is depicted as an unbroken line is therefore applicable up to M=180 kg/s, not the curve $K_5$ depicted as a broken line in this value range of M. That part of the curve $K_5$ which is depicted as an unbroken line is applicable to values of M which are higher than 180 kg/s, not the curve $K_2$ depicted as a broken line in this value range of M.

The burnup time $T_A$=2 s of the flame F of the fuel B and the outlet temperature of the fuel gas G from the combustion chamber $T_{BRK}$=1400° C. are assigned, for example, to the curves $K_3$ and $K_6$. This yields, in the case of a predetermined steam power output M of the continuous-flow steam generator 2 under full load, with M=80 kg/s a length of L=18 m according to $K_3$, with M=465 kg/s a length of L=21 m according to $K_3$ and $K_6$, with M=560 kg/s a length of L=23 m according to $K_6$.

The curve $K_3$ depicted as an unbroken line in this range is therefore applicable to values of M up to 465 kg/s, not the curve $K_6$ depicted as a broken line in this range. That part of the curve $K_6$ which is depicted as an unbroken line is applicable to values of M which are higher than 465 kg/s, not that part of the curve $K_3$ which is depicted as a broken line.

So that, when the continuous-flow steam generator 2 is in operation, a higher throughput of the flow medium S is established automatically in an evaporator tube 10 heated to a greater extent than in an evaporator tube 10 heated to a lesser extent, for a number N of evaporator tubes 10 connected in parallel the quotient of the steam power output M (given in kg/s) of the continuous-flow steam generator 2 under full load and the sum A (given in m$^2$) of the inner cross-sectional area of the number N of these evaporator tubes 10 capable of being acted upon in parallel by flow medium S and each having a tube inside diameter $D_N$ is selected such that the condition $$\frac{M}{A}=\frac{M}{\sum_{i=1}^{N}\pi\left(\frac{D_N}{2}\right)^2}<1350$$

is satisfied. Here, the number 1350 is given in kg/sm$^2$ and $D_N$ is the tube inside diameter of the Nth evaporator tube 10 with i=1 to N.

When the continuous-flow steam generator 2 is in operation, fossil fuel B is supplied to the burners 30. The flames F of the burners 30 are in this case oriented horizontally. By virtue of the form of construction of the combustion chamber 4, a flow of the fuel gas G occurring during combustion is generated in an approximately horizontal main flow direction 24. This fuel gas passes via the horizontal gas flue 6 into the vertical gas flue 8 oriented approximately toward the ground and leaves the latter in the direction of the chimney, not illustrated in any more detail.

Flow medium S entering the economizer 28 passes, via the convection heating surfaces 26 arranged in the vertical gas flue 8, into the inlet header system 18 of the evaporator tubes 10 of the combustion chamber 4 of the continuous-flow steam generator 2. Evaporation and, where appropriate, partial superheating of the flow medium S takes place in the vertically arranged evaporator tubes 10 of the combustion chamber 4 of the continuous-flow steam generator 2 which are welded to one another in a gastight manner. The steam or a water/steam mixture occurring at the same time is collected in the outlet header system 20 for flow medium S. The steam or the water/steam mixture passes from there, via the walls of the horizontal gas flue 6 and of the vertical gas flue 8, into the superheater heating surfaces 22 of the horizontal gas flue 6. Further superheating of the steam takes place in the superheater heating surfaces 22, said steam subsequently being supplied for utilization, for example for driving a steam turbine.

The limitation of the quotient of the steam power output M of the continuous-flow steam generator 2 under full load and the sum of the inner cross-sectional areas F to the value 1350 kg/sm$^2$ for a number N of evaporator tubes 10 connected in parallel ensures in a particularly simple way particularly low temperature differences between adjacent evaporator tubes 10, at the same time with particularly reliable cooling of the evaporator tubes 10 in all the load states of the continuous-flow steam generator 2. Moreover, the series connection of the evaporator tubes 10 is designed, in particular, for utilization of the approximately horizontal main flow direction 24 of the fuel gas G. In this case, a choice of the length L of the combustion chamber 4 as a function of the steam power output M of the continuous-flow steam generator 2 under full load ensures that the combustion heat of the fossil fuel B is utilized particularly reliably. Furthermore, the continuous-flow steam generator 2, because of its particularly low overall height and compact form of construction, can be set up at a particularly low outlay in terms of manufacture and assembly. In this case, a scaffold capable of being erected at a comparatively low technical outlay may be provided. In a power plant with a steam turbine and with a continuous-flow steam generator 2 having such a low overall height, moreover, the connecting tubes from the continuous-flow steam generator to the steam turbine can be designed to be particularly short.

We claim:

1. A continuous-flow steam generator, comprising:

a combustion chamber having a plurality of burners for fossil fuel and having a fuel-gas side;

a horizontal gas flue substantially at a level with said burners and a vertical gas flue following said combustion chamber on said fuel-gas side;

said combustion chamber having containment walls formed from substantially vertically arranged evaporator tubes welded to one another in a gastight manner, and including a plurality of evaporator tubes each formed with inner ribs defining a multiple thread;

a common inlet header system for a flow medium connected in common to a number of said evaporator tubes of said combustion chamber and a common outlet header system connected in common to said evaporator tubes, such that the number of said evaporator tubes can be acted upon in parallel by the flow medium;

wherein a quotient formed from a steam power output (given in kg/s) under full load of the continuous-flow steam generator and a sum (given in m$^2$) of an inner cross-sectional area of said number of said evaporator tubes capable of being acted upon in parallel by the flow medium is smaller than 1350 (given in kg/sm$^2$).

2. The continuous-flow steam generator according to claim 1, wherein said evaporator tubes define an end wall and other containment walls of said combustion chamber, and said evaporator tubes of said end wall precede on a flow-medium side said evaporator tubes of said other containment walls.

3. The continuous-flow steam generator according to claim 1, wherein a tube inside diameter of a number of said evaporator tubes of said combustion chamber is selected in dependence on a respective position of said evaporator tubes in said combustion chamber.

4. The continuous-flow steam generator according to claim 1, wherein said ribs have flanks enclosing a pitch angle of less than 60° with a plane perpendicular to a tube axis.

5. The continuous-flow steam generator according to claim 1, wherein said ribs have flanks enclosing a pitch angle of less than 55° with a plane perpendicular to a tube axis.

6. The continuous-flow steam generator according to claim 1, which comprises throttle devices each disposed to throttle a fluid flow in a number of said evaporator tubes.

7. The continuous-flow steam generator according to claim 1, which comprises a line system for feeding flow medium into said evaporator tubes of said combustion chamber, said line system having a number of throttle devices for reducing the throughflow of the flow medium.

8. The continuous-flow steam generator according to claim 7, wherein said throttle devices are throttle fittings.

9. The continuous-flow steam generator according to claim 1, wherein said horizontal gas flue has side walls formed from vertically arranged steam generator tubes welded to one another in a gastight manner and connected to be acted upon in parallel by flow medium.

10. The continuous-flow steam generator according to claim 1, wherein said vertical gas flue has side walls formed from vertically arranged steam generator tubes welded to one another in a gastight manner and connected to be acted upon in parallel by flow medium.

11. The continuous-flow steam generator according to claim 1, wherein adjacent said evaporator tubes are welded to one another in a gastight manner via fins having a given fin width, and the fin width is selected in dependence on a respective position of said evaporator tubes in said combustion chamber.

12. The continuous-flow steam generator according to claim 1, wherein adjacent steam generator tubes are welded to one another in a gastight manner via fins having a given fin width, and the fin width is selected in dependence on a respective position of said steam generator tubes in one of said horizontal gas flue and said vertical gas flue.

13. The continuous-flow steam generator according to claim 1, which further comprises a plurality of superheater heating surfaces disposed in suspended form of construction in said horizontal gas flue.

14. The continuous-flow steam generator according to claim 1, which further comprises a plurality of convection heating surfaces in said vertical gas flue.

15. The continuous-flow steam generator according to claim 1, wherein said burners are disposed on an end wall of said combustion chamber.

16. The continuous-flow steam generator according to claim 15, wherein a length of said combustion chamber, defined by the distance from an end wall of said combustion chamber to an inlet region of said horizontal gas flue, is at least equal to a burnup length of the fossil fuel when the steam generator is in full-load operating mode.

17. The continuous-flow steam generator according to claim 16, wherein said length of said combustion chamber is selected as a function of a plurality of parameters selected from the group consisting of a steam power output under full load, a burnup time of a flame of the fuel, and of an outlet temperature of the fuel gas from the combustion chamber, approximately in accordance with the following functions:

$$L(M, t_a)=(C_1+C_2\cdot M)\cdot t_a \text{ and}$$

$$L(M, T_{BRK})=(C_3T_{BRK}+C_4)M+C_5(T_{BRK})^2+C_6\cdot T_{BRK}+C_7$$

with $C_1$=8 m/s and $C_2$=0.0057 m/kg and $C_3=-1.905\cdot 10^{-4}$ (m·s)/(kg° C.) and $C_4$=0.286 (s·m)/kg and $C_5=3\cdot 10^{-4}$ m/(° C.)$^2$ and $C_6$=−0.842 m/° C. and $C_7$=603.41 m, where L is the length, $t_a$ is the burnup time, M is the steam power output, $T_{BRK}$ is the outlet temperature, and wherein in each case a higher value of the length of said combustion chamber applies to a predetermined steam power output under full load.

* * * * *